US005467888A

United States Patent [19]

Brändström et al.

[11] Patent Number: 5,467,888

[45] Date of Patent: Nov. 21, 1995

[54] AUXILIARY DEVICE FOR SEALING CANS FOR BEVERAGES

[75] Inventors: Paul Brändström; Runo Nord, both of Söderhamn, Sweden

[73] Assignee: Paul & Martha Brandstrom AB, Sweden

[21] Appl. No.: 196,217

[22] PCT Filed: Oct. 27, 1990

[86] PCT No.: PCT/SE93/00884

§ 371 Date: Mar. 16, 1994

§ 102(e) Date: Mar. 16, 1994

[87] PCT Pub. No.: WO94/13545

PCT Pub. Date: Jun. 23, 1994

[30] Foreign Application Priority Data

Dec. 11, 1992 [SE] Sweden ..... 9203725

[51] Int. Cl.[6] ..... B65D 25/48; B65D 45/32

[52] U.S. Cl. ..... 220/319; 220/717; 222/570

[58] Field of Search ..... 220/703, 711, 220/716, 717, 729, 375, 319, 320, 256, 254, 724, 281, 282, 286; 222/566, 570

[56] References Cited

U.S. PATENT DOCUMENTS

| | | | |
|---|---|---|---|
| 2,958,439 | 4/1959 | Yochem | 220/375 X |
| 3,680,731 | 8/1972 | Lelyk et al. | 220/319 |
| 3,851,788 | 12/1974 | Hammes | 220/319 |
| 4,248,262 | 2/1981 | Iwanaga | 220/724 X |
| 4,883,192 | 11/1989 | Krugman . | |
| 5,090,583 | 2/1992 | Hoffman et al. | 220/375 X |
| 5,165,579 | 11/1992 | Edison . | |
| 5,176,278 | 1/1993 | Quarberg . | |

FOREIGN PATENT DOCUMENTS

| | | |
|---|---|---|
| 107742 | 10/1965 | Denmark . |
| 1378591 | 12/1974 | France . |
| 1530165 | 10/1978 | Switzerland . |

*Primary Examiner*—Allan N. Shoap
*Assistant Examiner*—Nathan Newhouse

[57] ABSTRACT

An auxiliary device for sealing cans for beverages, of the type having a disposable opener mechanism, is shaped as a tubular element (9) which tapers off from a comparatively wide collar (7) to a narrower spout portion (8) and which, adjacent the collar, comprises means for snapping the collar on to the can. A locking ring (18) is arranged to cooperate with the collar (7) of the auxiliary device and serves, after snapping the collar on to the can, to clamp the collar to the can. The locking ring is connected to the auxiliary device via a connection which is formed by a tongue (13) on the auxiliary device and a slot in the locking ring, thereby permitting the locking ring to accompany the auxiliary device.

9 Claims, 2 Drawing Sheets

AUXILIARY DEVICE FOR SEALING CANS FOR BEVERAGES

FIELD OF THE INVENTION

The present invention relates to an auxiliary device for sealing cans for beverages or the like, of the type having on an end wall a disposable opener mechanism, i.e. a mechanism which after uncovering an opening in the end wall does not permit resealing thereof, the auxiliary device having the form of a tubular element which tapers off from a comparatively wide collar to a narrower spout portion and which, adjacent the collar, comprises means for snapping the auxiliary device on to the opening end of the can, preferably to an annular element defining the end wall and, in the area of the spout portion, comprises means, e.g. a cap, permitting both closing and opening of the spout portion as desired.

DESCRIPTION OF THE PRIOR ART

An auxiliary device of the type generally described above is disclosed in U.S. Pat. No. 4,883,192. A similar auxiliary device is also disclosed in U.S. Pat. No. 4,579,257.

Contradictory demands are placed on such auxiliary devices for cans. On the one hand, the collar of the auxiliary device, which should be snapped on to one end of the can, particularly to the annular element which in most cases defines the can end wall, should be designed to have such a close fit relative to the can end or the annular element that the auxiliary device, when applied, is firmly fixed to the can so as to withstand any excess pressure arising in the interior which is common to the can and the auxiliary device. In cans with carbonated beverages there is always a certain excess pressure which can become comparatively high if the can is subjected to shaking or impacts. The auxiliary device needs to be firmly fixed to the can also for the reason that it should not be unintentionally detached from its applied position by some simple mechanical action. On the other hand, it should be possible to intentionally fix the auxiliary device to the can and detach it therefrom, without applying extremely great forces, since otherwise the auxiliary device will be considered too complicated to use.

SUMMARY OF THE INVENTION

The present invention aims at eliminating the above-mentioned problems in prior-art can auxiliary devices and providing such a device which can be applied to and intentionally be detached from cans in a smooth and easy and also quick manner, at the same time as it can be firmly retained on the can when used. The main object of the invention is therefore to provide a can auxiliary device which is reliably retainable when used and easily detachable when intentionally removed and which can be repeatedly used for different cans. A further object is to enable manufacture of the auxiliary device by simple and inexpensive means.

At least the main object of the invention is achieved by means of the features defined in the characterising clause of claim 1. Preferred embodiments of the invention are recited in claims 2–7.

Further Description of the Prior Art

GB 1,378,591 discloses a cap which is intended for bottles and is retained in its sealing state on the bottleneck by means of an external locking ring which, in the bottling procedure, is pressed down along a collar-shaped skirt of the cap for the purpose of snapping or clamping a thickened portion on to the lower edge of the cap skirt in the area below a shoulder on the bottleneck. Even if GB 1,378,591 mentions the possibility of using said ring repeatedly, after opening the bottle—which can be carried out only after tearing off a special securing element—this is a disposable cap construction in so far as it is not intended for use on other bottles than the one to which it was initially applied. In this prior-art cap construction, there is no connection which enables pivoting of the locking ring between the locking and unlocking positions. It is therefore necessary for the ring to be pressed down in parallel with the cap, which is difficult to carry out manually if re-use is considered.

Moreover, NO 107,742 discloses a disposable cap with a special locking ring which, when pressed down to the lower portion of a cap skirt, presses this portion into the area below a shoulder on the bottleneck. However, when removing the cap, the locking ring bursts and, consequently, cannot be re-used at all.

BRIEF DESCRIPTION OF THE ACCOMPANYING DRAWINGS

In the drawings

FIG. 1 is a perspective view of a can auxiliary device according to the present invention, FIGS. 2–4 are side views of the auxiliary device in FIG. 1, applied to a beverage can, the auxiliary device being illustrated in three different functional positions, FIG. 5 is a top plan view of the actual auxiliary device, FIG. 6 is a top plan view of a locking ring of the auxiliary device, shown separately, FIG. 7 is a top plan view of the auxiliary device and the locking ring, FIG. 8 is a cross-sectional view along the line VIII—VIII in FIG. 7, on a large scale, and FIG. 9 is a cross-sectional view along the line IX—IX in FIG. 7, on a larger scale, the locking ring being separated from the auxiliary device.

FIGS. 1–4 illustrate an auxiliary device generally designated 1 and intended to be applied to beer or soft drink cans designated 2 and comprising, in a manner known per se, a cylindrical main portion 3 and two opposite end walls of which only one is shown in FIGS. 2–4 and is designated 4. In practice, the can is made of thin metal sheet, particularly sheet aluminium. The upper end wall 4 is mounted by means of annular element 5 after filling of the can. The annular element 5 is placed at the upper end of a transition portion 6 in the form of a truncated cone. The upper end wall 4 further comprises an opener mechanism (not shown) by means of which an opening in the end wall can be uncovered. The opener mechanism is disposable, i.e. it does not permit resealing of the opening once made.

The actual auxiliary device 1 is shaped as a tubular element which tapers off from a comparatively wide collar 7 to a narrower spout portion 8. In the illustrated embodiment, the tapering off occurs via a portion 9 in the form of a truncated cone. The spout portion 8 is fitted with a cap 10 connected with the spout portion via a strip 12 which is integrated with a ring 11. The cap is attachable to the spout portion via a prior art or arbitrary snap-on connection. Instead of precisely a snap-on cap, it is possible to use other sealing means, for example screw caps of the type disclosed in U.S. Pat. No. 4,883,192.

From the outside of the collar 7, there projects a tongue 13 (see also FIG. 8) which is operable by the user's fingers, both when applying the auxiliary device to a can and when detaching it therefrom.

As seen in FIGS. 8 and 9, the inside of the collar 7 is formed with a thickened portion 14 having a lower, annular flat surface 15 which forms an abutment engaging the annular element 5 of the can and determining the vertical position of the auxiliary device 1 relative to the can. The inside of the collar is also formed with a lower, truncatedly conically shaped surface 16 connecting with the truncatedly conical shape of the transition portion 6. Between the surface 16 and the abutment surface 15, the inside of the collar is formed with a groove 17 into which the annular element 5 of the can engages after snapping the auxiliary device 1 on to the can. In actual practice, the auxiliary device is made of plastic which, because of its inherent elasticity, permits said snapping on.

As described so far, the illustrated can auxiliary device is in every essential respect disclosed in e.g. U.S. Pat. No. 4,883,192.

DETAILED DESCRIPTION OF A PREFERRED EMBODIMENT OF THE INVENTION

Figure 4:
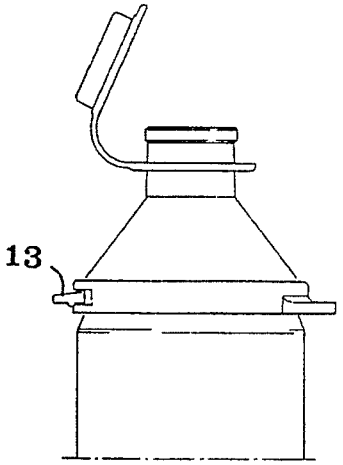
Figure 6:
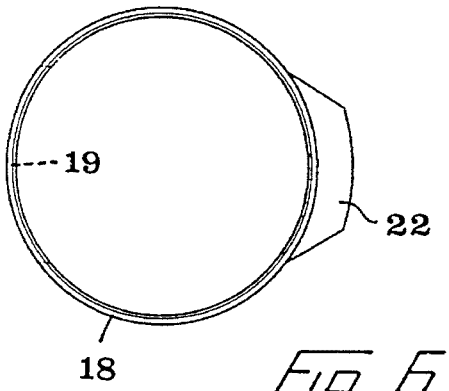
Figure 7:
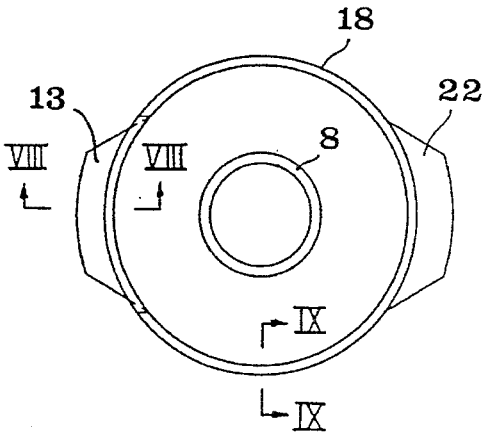
Figure 5:
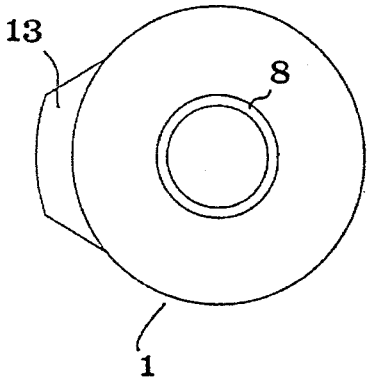
Figure 8:
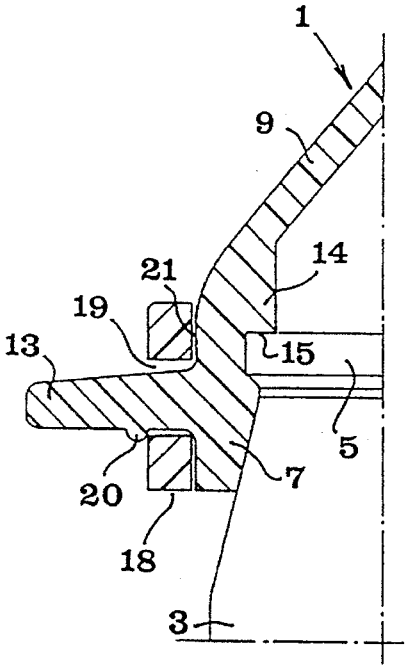
Figure 9:
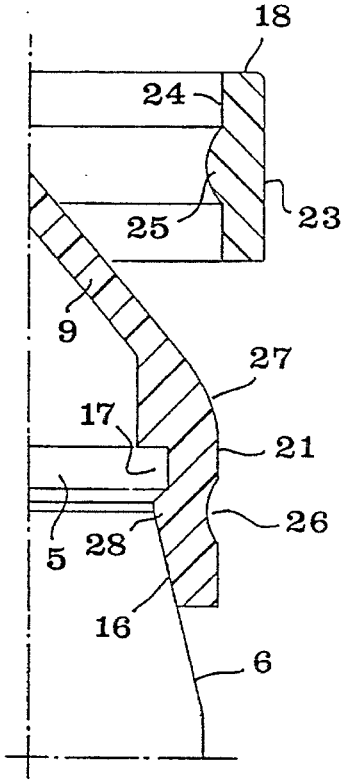

According to the invention, the auxiliary device 1 is associated with a particular locking ring 18 which is connected to the collar 17 to be able to accompany the auxiliary device whether this is applied to the can or not. The connection between the locking ring and the auxiliary device is established by the locking ring being formed with a slot 19 (see FIGS. 6 and 8) whose circumferential extent is at least as great as the circumferential extent of the gripping tongue 13 (e.g. in the range of 70°–80°), the tongue 13 being caused to engage the slot. One side of the tongue 13 can be formed with a suitably wart-like projection 20 spaced from the essentially cylindrical, outer circumferential surface 21 of the collar 7. More precisely, the distance between the projection 20 and the circumferential surface 21 of the collar is about as great as the thickness of the locking ring 18. The projection 20 will therefore establish reliable retaining of the locking ring in connection with the auxiliary device. The side of the locking ring opposite the slot 19 is formed with a gripping tongue 22 similar to the tongue 13 of the auxiliary device. In practice, the ring 18 is—like the auxiliary device 1—made of plastic having at least some inherent elasticity. The ring is essentially cylinder-shaped, defined by external and internal, essentially cylindrical surfaces 23 and 24, respectively (see FIG. 9). The inside of the ring is, however, formed with a cross-sectionally softly rounded bead 25 adapted to engage into a corresponding groove 26 on the outside of the collar 7. Both the bead 25 and the groove 26 can advantageously extend along the major part of the circumference of the locking ring and the collar, respectively, more precisely up to the slot 19 and the tongue 13, respectively. Said bead serves to retain the locking ring 18 in its clamping position according to FIG. 4.

It should be particularly pointed out that the auxiliary device 1 and the locking ring 18 are designed as separate units which are interconnected, after being manufactured separately.

The locking ring 18 may have an inner diameter which is slightly smaller than the outer diameter of the collar 7. More precisely, the cylindrical inner surface 24 of the locking ring 18 is of a smaller diameter than the cylindrical circumferential surface 21 of the collar 7. The difference in diameter between these two surfaces may advantageously be in the range 0.3–2.0%, preferably 0.5–1.0%. In practice, the outer circumferential surface 21 of the collar may have a diameter of 64.0 mm, at the same time as the inner cylindrical surface 24 of the locking ring 18 has a diameter of 63.0 mm (the locking ring having a wall thickness of 2.0 mm and a width of 10 mm). It should also be noted that the outer circumferential surface 21 of the collar 7 merges into the external surface of the conical wall portion 9 of the auxiliary device via a surface 27 of softly rounded shape.

Function and Advantages of the Invention

Figure 1:
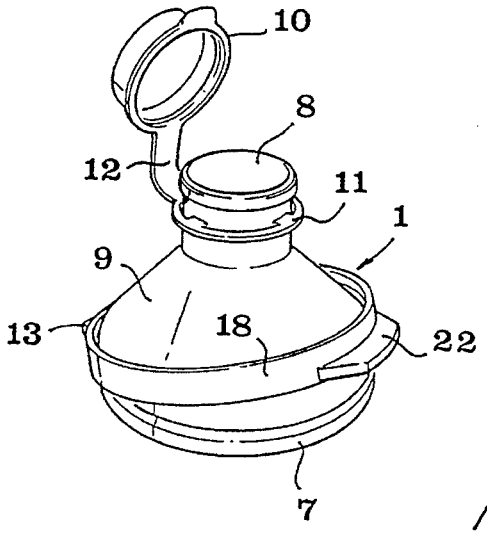
Figure 2:
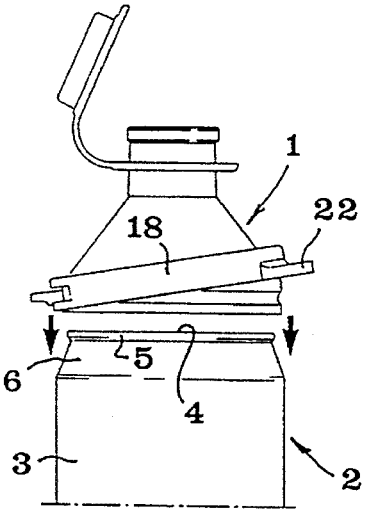
Figure 3:
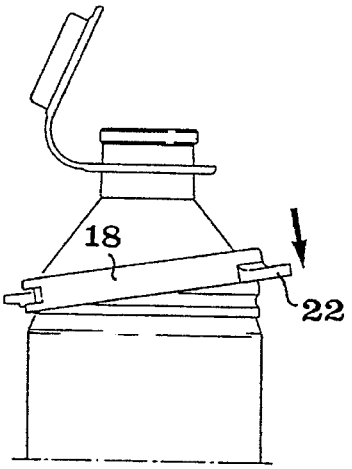

When the auxiliary device 1, as illustrated in FIG. 2, is to be snapped on to the can 2, the locking ring 18 is pivoted to an upper position in which the gripping tongue 22 is spaced from the collar 7. The collar 7 of the auxiliary device may have a comparatively loose or wide fit relative to the annular element 5 of the can, whereby the auxiliary device can smoothly and easily be snapped on to the can, without applying any considerable force. After completing the snapping-on operation, as illustrated in FIG. 3, the locking ring 18 is pivoted downwards in the direction of the arrow, while the connection which is formed by the tongue 13 and the slot 19 serves as a hinge between the locking ring and the auxiliary device. The downward pivoting is effected by using a finger to press the tongue 22. When the locking ring has been pivoted in this manner to the position shown in FIG. 4, it will, having first passed the softly rounded transition surface 27, be forced past the annular element 5 and then, finally, its internal bead 25 will engage into the groove 26 on the outside of the collar. Since the locking ring has an inner diameter which is smaller than the outer diameter of the collar, it will, in this state, clamp the collar to the upper end portion of the can such that the shoulder 28 (see FIG. 9) positioned below the internal groove 17 of the collar is firmly pressed under the annular element 5, although initially the collar had a relatively loose fit relative to the annular element. In the position illustrated in FIG. 4, the auxiliary device is thus retained very firmly and reliably, which implies that it cannot be unintentionally detached owing to any high excess pressure arising in the common interior of the can and the auxiliary device or owing to any unintentional mechanical damage caused to the auxiliary device.

When, after emptying the contents of the can, the auxiliary device 1 should be intentionally detached from the can, the locking ring 18 is pivoted back to its initial position shown in FIG. 3 by applying a pressure to the lower side of the tongue 22. When the locking ring has in this manner been returned to its initial position, the auxiliary device may readily be detached from the can owing to its still loose fit relative to the can.

Possible Modifications of the Invention

The invention is, of course, not restricted to the embodiment described above and shown in the drawings. Thus, the locking ring function of clamping the collar to the end portion of the can be accomplished in various ways. In the embodiment shown, the inner surface 24 of the ring is of a smaller diameter than the corresponding outer circumferential surface 21 of the collar, at the same time as the cross-sectional area of the bead 25 and that of the groove 26 are of essentially the same size. However, it is possible to design the actual bead 25 with a smaller minimum diameter than the minimum diameter of the groove, at the same time as the cylindrical annular surface 24 is of a diameter which is as great as or even greater than the outer diameter of the circumferential surface 21 of the collar. In the embodiment illustrated, the bead 25 is intended to extend continuously along the major part of the circumference of the locking ring. It is, however, also possible to use, instead of a continuous bead, a number of spaced-apart knobs or projections protruding from the locking ring inside and jointly effecting the clamping action of the locking ring. Instead of arranging the groove 26 in the collar and the bead 25 on the locking ring, it is of course also possible to arrange the bead on the outside of the collar and the groove on the inside of the locking ring. It is also possible to spare every combination of engaging beads and grooves, the locking ring being retained in some other manner, e.g. by means of a projecting flange on the lower part of the collar should also be pointed out that owing to the connection formed by the tongue 13 and the slot 19, the locking ring and the auxiliary device will always accompany each other such that the locking ring is always safely available in conjunction with the snapping-on of the auxiliary device to the can.

We claim:

1. Auxiliary device suitable for sealing cans for beverages having on an end wall a disposable opener mechanism, the auxiliary device including a tubular element tapering from a comparatively wide collar to a narrower spout portion and which, adjacent the collar, includes means for snapping the auxiliary device onto the opening end of the can, said spout portion, including means for permitting both closing and opening of said spout portion as desired, characterized in that a locking ring cooperates with said collar for clamping the collar to said end wall, the locking ring being connected to the auxiliary device by a connection comprising a tongue projecting from the outside of said collar and a slot formed in the locking ring and into which said tongue engages, the connection permitting pivoting of the ring between locking and unlocking positions.

2. Auxiliary device as claimed in claim 1, characterized in that one side of said tongue is formed with a projection spaced from said collar and serving to counteract displacement of the locking ring relative to the tongue.

3. Auxiliary device as claimed in claim 1, characterized in that the locking ring is made of an elastically yieldable material and has, when free of tension, an inner diameter which is smaller than the outer diameter of said collar.

4. Auxiliary device as claimed in claim 1, characterized in that the inside of said locking ring is formed with a bead for engaging into a groove on the outside of said collar.

5. Auxiliary device as claimed in claim 4, characterized in that the groove receiving said bead is positioned on a level below an abutment which is arranged on the inside of said collar and determines the vertical position of said collar relative to said can.

6. Auxiliary device as claimed in claim 4, characterized in that the groove extends along a major part of the circumference of said collar, at the same side as said bead extends along a major part of the circumference of said locking ring.

7. Auxiliary device as claimed in claim 1, characterized in that a transition surface extends between the tapering portion of said auxiliary device and the outside of said collar and which transition surface is slightly rounded.

8. Auxiliary device as claimed in claim 5, characterized in that the groove extends along a major part of the circumference of said collar, at the same side as said bead extends along a major part of the circumference of said locking ring.

9. Auxiliary device as claimed in claim 2, characterized in that said locking ring is made of an elastically yieldable material and has, when free of tension, an inner diameter which is smaller than the outer diameter of said collar.

* * * * *